US008201415B2

(12) United States Patent
Nakamura et al.

(10) Patent No.: US 8,201,415 B2
(45) Date of Patent: Jun. 19, 2012

(54) INTEGRATED UNIT FOR REFRIGERATION CYCLE DEVICE

(75) Inventors: Masaya Nakamura, Kariya (JP); Thuya Aung, Kariya (JP); Tomoya Ishii, Nishikamo-gun (JP); Keiichi Yoshii, Anjo (JP)

(73) Assignee: Denso Corporation, Kariya (JP)

( * ) Notice: Subject to any disclaimer, the term of this patent is extended or adjusted under 35 U.S.C. 154(b) by 997 days.

(21) Appl. No.: 12/157,592

(22) Filed: Jun. 11, 2008

(65) Prior Publication Data

US 2008/0314074 A1 Dec. 25, 2008

(30) Foreign Application Priority Data

Jun. 20, 2007 (JP) ..... 2007-162504

(51) Int. Cl.
*F25B 19/02* (2006.01)
*F25B 1/06* (2006.01)

(52) U.S. Cl. ..... 62/170; 62/191; 62/500

(58) Field of Classification Search ..... 62/86, 170, 62/191, 500, 528, 296; 165/174, 175, 176; 137/15.01, 823, 888; 521/900; 417/151, 417/168

See application file for complete search history.

(56) References Cited

U.S. PATENT DOCUMENTS

| | | | | |
|---|---|---|---|---|
| 2,195,228 | A * | 3/1940 | Schwarz | 62/113 |
| 6,596,159 | B1 * | 7/2003 | Maruyama et al. | 210/139 |
| 7,178,359 | B2 | 2/2007 | Oshitani et al. | |
| 7,254,961 | B2 | 8/2007 | Oshitani et al. | |
| 2006/0266072 | A1 * | 11/2006 | Takeuchi et al. | 62/500 |

FOREIGN PATENT DOCUMENTS

| | | |
|---|---|---|
| JP | 0-137695 | 5/1994 |
| JP | 2005-308380 | 11/2005 |
| JP | 2005-308384 | 11/2005 |
| JP | 2007-057222 | 3/2007 |
| WO | WO 2006/109617 | 10/2006 |

* cited by examiner

*Primary Examiner* — Frantz Jules
*Assistant Examiner* — Webeshet Mengesha
(74) *Attorney, Agent, or Firm* — Harness, Dickey & Pierce, PLC

(57) ABSTRACT

In an integrated unit including an evaporator and an ejector located inside a tank of the evaporator, a first vibration-isolating seal member and a second vibration-isolating seal member are disposed in a gap between an outer surface of the ejector and an inner surface of the tank. The first vibration-isolating seal member is located between a refrigerant discharge port and a refrigerant suction port of the ejector in a longitudinal direction, and the second vibration-isolating seal member is located between a refrigerant flow inlet of the ejector and the refrigerant suction port in the longitudinal direction. Furthermore, the first vibration-isolating seal member has a seal capability lower than that of the second vibration-isolating seal member, and a vibration isolation capability higher than that of the second vibration-isolating seal member.

8 Claims, 8 Drawing Sheets

INTEGRATED UNIT FOR REFRIGERATION CYCLE DEVICE

CROSS REFERENCE TO RELATED APPLICATION

This application is based on Japanese Patent Application No. 2007-162504 filed on Jun. 20, 2007, the contents of which are incorporated herein by reference in its entirety.

FIELD OF THE INVENTION

The present invention relates to an integrated unit for a refrigeration cycle device including an ejector serving as refrigeration decompression means and refrigeration circulation means.

BACKGROUND OF THE INVENTION

Conventionally, a refrigeration cycle device is known which includes an ejector serving as refrigerant decompression means and refrigerant circulation means. The refrigeration cycle device having the ejector is effectively used, for example, for an air conditioner for a vehicle, a refrigeration device for freezing and refrigerating goods mounted on a vehicle, or the like. Further, the refrigeration cycle device is also effectively used as a stationary refrigerant cycle system, for example, an air conditioner, a refrigerator, a freezer, and the like.

JP-A-2007-57222 (corresponding to WO 2006/109617 A1) proposes such a refrigeration cycle device. In this document, an ejector is formed integrally with an evaporator. Thus, the ejector and the evaporator can be handled as one integrated unit, thereby improving the mounting property of the refrigeration cycle device on a vehicle.

Specifically, as shown in FIG. 12, a first evaporator 15 and a second evaporator 18 are assembled to an integrated structure, and an ejector 14 is incorporated in a tank 18*b* of the second evaporator 18.

The ejector 14 draws refrigerant from a refrigerant suction port 14*b* by a refrigerant flow injected from a nozzle portion, and mixes the refrigerant injected from the nozzle portion with the refrigerant drawn from the refrigerant suction port 14*b* to discharge the mixed refrigerant from a diffuser.

The ejector 14 has an elongated shape with a refrigerant flow inlet 14*e* of the nozzle portion located on one end side thereof in the longitudinal direction (on the left end side shown in FIG. 12), and a refrigerant discharge port 14*f* of the diffuser located on the other end side thereof in the longitudinal direction (on the right end shown in FIG. 12). The refrigerant suction port 14*b* is located between the refrigerant flow inlet 14*e* and the refrigerant discharge port 14*f* in the longitudinal direction of the ejector 14.

The refrigerant suction port 14*b* of the ejector 14 is opened to a collection space 27 for collecting the refrigerant flowing from a plurality of tubes (not shown) in the tank 18*b* of the second evaporator 18. The refrigerant in the collection space 27 is drawn into the ejector 14 from the refrigerant suction port 14*b*.

A first O-ring (elastic member) 29*a* is provided for preventing the refrigerant discharged from the refrigerant discharge port 14*f* of the diffuser from leaking into the collection space 27 as shown by the arrow X with the broken line in FIG. 12. A second O-ring (elastic member) 29*b* is provided for preventing the refrigerant flowing into the refrigerant flow inlet 14*e* of the nozzle portion from leaking into the collection space 27 as shown by the arrow Y with the broken line in FIG. 12.

With this arrangement, the ejector 14 can be fixed in the longitudinal direction by using screw fixing means.

However, according to the detailed studies by the inventors of the present application, incorporating the ejector 14 in the tank 18*b* of the second evaporator 18 may generate abnormal noise from the evaporator 18.

That is, since the ejector 14 serves as refrigerant decompression means, vibration occurs from the ejector 14 due to disturbance of the refrigerant flow in decompression of the refrigerant. The ejector 14 is incorporated and fixed in and to the tank 18*b* of the evaporator 18 by screws, which allows the vibration of the ejector 14 to be easily transmitted to the tank 18*b*.

Thus, the vibration generated from the ejector 14 may be transmitted to the entire evaporator 18 itself, resulting in radiated sound (abnormal noise) from the evaporator 18.

The inventors of the present application have studied about prevention of the transmission of vibration from the ejector 14 to the tank 18*b* by effectively using vibration isolation capability of the O-rings 29*a* and 29*b*, taking into consideration the contact between the ejector 14 and the tank 18*b* via the O-rings (elastic members) 29*a* and 29*b* and the vibration isolation capability of the general elastic member.

The vibration isolation capability of the O-rings 29*a* and 29*b*, however, is contradictory to seal capability inherent to the O-rings 29*a* and 29*b*. That is, in order for the O-rings 29*a* and 29*b* to have sufficient vibration isolation capability, it is only necessary to decrease the hardness of each of the O-rings 29*a* and 29*b*, thereby improving a buffer effect thereof. In contrast, the decrease in hardness of the O-rings 29*a* and 29*b* leads to degradation of adhesion and further of the seal capability.

For this reason, simply by decreasing the hardness of the O-rings 29*a* and 29*b*, the vibration isolation capability of each of the O-rings 29*a* and 29*b* may be improved, but the seal capability thereof cannot be assured. Thus, it may cause a leak of the refrigerant as indicated by the arrow X or Y with the broken line in FIG. 12.

SUMMARY OF THE INVENTION

In view of the foregoing problems, it is an object of the present invention to provide an integrated unit for a refrigeration cycle device, which can effectively reduce transmission of vibration from an ejector to an evaporator while ensuring seal capability.

According to the present invention, an integrated unit for a refrigeration cycle device includes an ejector having an elongated shape elongated in a longitudinal direction, and an evaporator. The ejector includes a nozzle portion, a refrigerant suction port for drawing refrigerant by a refrigerant flow injected from the nozzle portion, and a diffuser configured to mix the refrigerant injected from the nozzle portion and the refrigerant drawn from the refrigerant suction port and to discharge the mixed refrigerant therefrom. The evaporator for evaporating the refrigerant to be drawn into at least the refrigerant suction port, includes at least a plurality of tubes for allowing the refrigerant to flow therethrough, and a tank for collecting the refrigerant flowing from the tubes. The ejector is disposed inside the tank such that the refrigerant suction port is opened to an internal space of the tank. In the integrated unit, a first vibration-isolating seal member and a second vibration-isolating seal member are disposed in a gap between an outer surface of the ejector and an inner surface of the tank, each of the first and second vibration-isolating seal members is made of elastic material, and the elastic material has a seal capability for preventing the refrigerant from leaking from the gap and a vibration isolation capability for preventing vibration of the ejector from being transmitted to the tank. Furthermore, the ejector has a refrigerant flow inlet located at one end side of the ejector in the longitudinal direction for allowing the refrigerant to flow into the nozzle portion, and a refrigerant discharge port in the diffuser, for discharging the refrigerant from the diffuser, at the other end side of the ejector in the longitudinal direction. In addition, the refrigerant suction port is located between the refrigerant flow inlet and the refrigerant discharge port in the longitudinal direction of the ejector, the ejector serves as a refrigerant decompression means adapted to make a pressure of the refrigerant discharged from the refrigerant discharge port lower than that of the refrigerant flowing into the refrigerant flow inlet.

In the integrated unit, the first vibration-isolating seal member is disposed between the refrigerant discharge port and the refrigerant suction port in the longitudinal direction to prevent the refrigerant discharged from the refrigerant discharge port from leaking to the internal space, the second vibration-isolating seal member is disposed between the refrigerant flow inlet and the refrigerant suction port in the longitudinal direction to prevent the refrigerant flowing into the refrigerant flow inlet from leaking to the internal space, and the first vibration-isolating seal member has the seal capability lower than that of the second vibration-isolating seal member and the vibration isolation capability higher than that of the second vibration-isolating seal member.

In the refrigeration cycle device, the refrigerant flowing into the refrigerant flow inlet of the ejector has a pressure that is relatively high. In contrast, the refrigerant discharged from the refrigerant outlet has a pressure that is relatively low. Thus, the seal capability required for the first vibration-isolating seal member is lower than that required for the second vibration-isolating seal member. From this viewpoint, the seal capability of the first vibration-isolating seal member is set lower than that of the second vibration-isolating seal member, and thus the vibration isolation capability of the first vibration-isolating seal member is set higher than that of the second vibration-isolating seal member. This can effectively improve the vibration isolation capability of the first vibration-isolating seal member, while preventing a leak of the refrigerant in the first vibration-isolating seal member.

For example, a hardness of the first vibration-isolating seal member may be set lower than that of the second vibration-isolating seal member to obtain the seal capability and the vibration isolation capability. As an example, the hardness of the first vibration-isolating seal member is in a range of 60 to 80% of the hardness of the second vibration-isolating seal member.

Alternatively, the second vibration-isolating seal member may be constructed of a plurality of elastic members, and the first vibration-isolating seal member may be constructed of at least one elastic member. In this case, the number of the first vibration-isolating seal member can be smaller than that of the elastic members of the second vibration-isolating seal member thereby to obtain the seal capability and the vibration isolation capability.

Alternatively, each of the first and second vibration-isolating seal members may be configured to have a ring shape that surrounds an outer peripheral surface of the ejector. In this case, the first vibration-isolating seal member has a sectional shape in which a length of contact with an inner surface of the tank is shorter than that of contact with an outer surface of the ejector in a cross section of the first vibration-isolating seal member perpendicular to a circumferential direction thereof, and the second vibration-isolating seal member has a sectional shape in which a difference between a length of contact with the outer surface of the ejector and a length of contact with the inner surface of the tank is small in a cross section of the second vibration-isolating seal member perpendicular to a circumferential direction thereof, as compared to that in the first vibration-isolating seal member, thereby to obtain the seal capability and the vibration isolation capability.

For example, the first vibration-isolating seal member may have a substantially triangle sectional shape with a base thereof being in contact with the outer surface of the ejector and a top thereof opposed to the base being in contact with the inner surface of the tank, and the second vibration-isolating seal member may have a substantially circular sectional shape.

In the integrated unit for the refrigeration cycle device, the tank may have a tank side protrusion provided at the inner surface thereof and protruding toward the outer surface of the ejector, and the ejector may have an ejector side protrusion provided at the outer surface thereof and protruding toward the inner surface of the tank. In this case, the ejector side protrusion can be engaged with the tank side protrusion in the longitudinal direction toward the refrigerant discharge port from the refrigerant flow inlet. For example, the ejector side protrusion is engaged with the tank side protrusion via any one of the first vibration-isolating seal member and the second vibration-isolating seal member.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

An integrated unit for a refrigeration cycle device and the refrigeration cycle device using the integrated unit according to embodiments of the invention will be described below. The integrated unit for the refrigeration cycle device is an integrated unit equipped with at least an evaporator and an ejector, for example.

The integrated unit for the refrigeration cycle device is connected to a condenser and a compressor, which are other components of the refrigeration cycle device, via pipes so as to construct the refrigeration cycle device including the ejector. The integrated unit for the refrigeration cycle device in one example can be applied to an indoor unit for cooling air. In another example, the integrated unit for the refrigeration cycle device can be used as an outdoor unit.

(First Embodiment)

Figure 1:
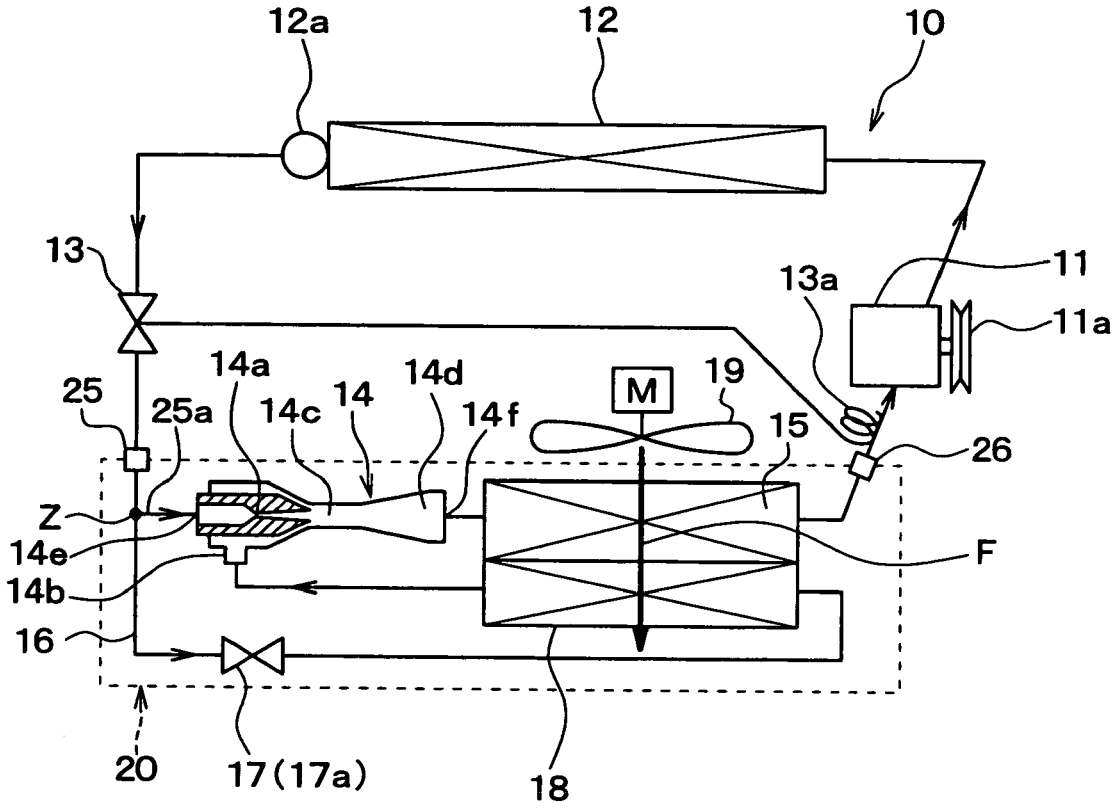
FIG. 1 is a refrigerant circuit diagram of a refrigeration cycle device according to a first embodiment of the invention.

A first embodiment of the present invention will be now described with reference to FIGS. 1 to 6B. FIG. 1 shows an example in which a refrigeration cycle device 10 of the first embodiment is used for a refrigeration cycle device for a vehicle. In the refrigeration cycle device 10 of this embodiment, a compressor 11 for sucking and compressing refrigerant is rotatably driven by an engine for vehicle running (not shown) via an electromagnetic clutch 11*a*, a belt, and the like.

As the compressor 11, may be used either a variable displacement compressor for being capable of adjusting a refrigerant discharge capacity by a change in discharge volume, or a fixed displacement compressor for adjusting a refrigerant discharge capacity by changing an operating efficiency of the compressor by intermittent connection of the electromagnetic clutch 11*a*. When an electric compressor is used as the compressor 11, the compressor 11 can adjust the refrigerant discharge capacity by adjustment of the number of revolutions of an electric motor.

A radiator 12 is disposed on the refrigerant discharge side of the compressor 11. The radiator 12 exchanges heat between high-pressure refrigerant discharged from the compressor 11 and outside air (air outside a vehicle compartment) blown by a cooling fan (not shown) to cool the high-pressure refrigerant.

In this embodiment, refrigerant whose high-pressure side pressure does not exceed the critical pressure, such as a flon-based or HC-based refrigerant, is used as the refrigerant for the refrigeration cycle device 10 to form a vapor-compression subcritical cycle. Thus, the radiator 12 serves as a condenser for cooling and condensing the refrigerant.

A liquid receiver 12*a* is provided on the outlet side of the radiator 12. The liquid receiver 12*a* has a vertically oriented tank shape to be well known, and serves as a gas-liquid separator for separating the refrigerant into gas and liquid phases to store the excess liquid refrigerant in the cycle. The liquid refrigerant is guided to flow from the lower part of the inside of the tank shape at the outlet of the liquid receiver 12*a*. The liquid receiver 12*a* is integrally formed with the radiator 12 in this embodiment.

The radiator 12 may have the known structure including a first heat exchange portion for condensation disposed on the upstream side of the refrigerant flow, the liquid receiver 12*a* for receiving the refrigerant introduced from the heat exchange portion for condensation to separate the refrigerant into gas and liquid phases, and a second heat exchange portion for supercooling of the saturated liquid refrigerant from the liquid receiver 12*a*.

A thermal expansion valve 13 is disposed on the outlet side of the liquid receiver 12*a*. The thermal expansion valve 13 serves as a decompression device for decompressing the liquid refrigerant from the liquid receiver 12*a*, and has a temperature sensing portion 13*a* disposed in a passage on the suction side of the compressor 11.

The thermal expansion valve 13 detects a degree of superheat of the refrigerant on the suction side of the compressor 11 based on the temperature and pressure of the suction side refrigerant of the compressor 11. Here, the suction side refrigerant of the compressor 11 corresponds to the refrigerant on the outlet side of an evaporator to be described later. The expansion valve 13 adjusts a degree of opening of a valve such that the degree of superheat of refrigerant on the compressor suction side is a preset predetermined value while a refrigerant flow amount can be adjusted, as being generally known.

An ejector 14 is disposed on the outlet side of the thermal expansion valve 13. The ejector 14 serves as a decompression means for decompressing the refrigerant, and also as a refrigerant circulation means (kinetic vacuum pump) for performing fluid transport so as to circulate the refrigerant by a suction action (an entrainment action) of a refrigerant flow ejected at high velocity.

The ejector 14 includes a nozzle portion 14*a* that decreases the passage sectional area of the refrigerant having passed through the thermal expansion valve 13 (intermediate-pressure refrigerant) to decompress and expand the refrigerant. The ejector 14 also includes a refrigerant suction port 14*b* that is arranged in the same space as a refrigerant ejection port of the nozzle portion 14*a* to draw the gas-phase refrigerant from a second evaporator 18 to be described later.

In the ejector 14, a mixing portion 14*c* is provided on a downstream side of the nozzle portion 14*a* and the refrigerant suction port 14*b* in a refrigerant flow, so as to mix the high-velocity refrigerant flow from the nozzle portion 14*a* with the suction refrigerant drawn into the refrigerant suction port 14*b*. Furthermore, a diffuser 14*d* serving as a pressure increasing portion is disposed on a downstream side of the refrigerant flow of the mixing portion 14*c*. The diffuser 14*d* is formed in such a shape to gradually increase the passage sectional area of the refrigerant, and has an effect of reducing the velocity of the refrigerant flow to increase the refrigerant pressure, that is, an effect of converting the velocity energy of the refrigerant to the pressure energy thereof.

The ejector 14 has a shape that extends substantially cylindrically in an elongated manner elongated in a longitudinal direction. The ejector 14 includes a refrigerant flow inlet 14*e* of the nozzle portion 14*a* located on one end side thereof in the longitudinal direction (on the left end side thereof shown in FIG. 1), and a refrigerant discharge port 14*f* of the diffuser 14*d* disposed on the other end side thereof in the longitudinal direction (on the right end side thereof shown in FIG. 1). The refrigerant suction port 14*b* is disposed between the refrigerant flow inlet 14*e* and the refrigerant discharge port 14*f* in the longitudinal direction of the ejector 14 (in the direction from left to right shown in FIG. 1).

A first evaporator 15 is connected to an outlet of the ejector 14, which is positioned at the refrigerant discharge port 14*f* of the diffuser 14*d*. Furthermore, a refrigerant outlet of the first evaporator 15 is coupled to the suction side of the compressor 11.

In contrast, a refrigerant branch passage 16 branches from an inlet side of the ejector 14, at an intermediate part between the outlet side of the thermal expansion valve 13 and the inlet side of the ejector 14. The refrigerant branch passage 16 has a downstream side portion that is connected to the refrigerant suction port 14*b* of the ejector 14. A point z in FIG. 1 indicates a branch point of the refrigerant branch passage 16, branched from a refrigerant passage portion between the thermal expansion valve 13 and an inlet portion of the nozzle 14*a* of the ejector 14.

A throttle mechanism 17 is disposed in the refrigerant branch passage 16, and a second evaporator 18 is disposed on a downstream side from the throttle mechanism 17. The throttle mechanism 17 is a decompression means serving to exhibit an adjustment effect of the refrigerant flow amount into the second evaporator 18. Specifically, the throttle mechanism can be constructed of a capillary tube 17*a* or an orifice. The second evaporator 18 can be used as an evaporator in an evaporator integrated unit, as an example.

In this embodiment, two evaporators 15 and 18 are assembled to an integrated structure with the following arrangement. The two evaporators 15 and 18 are accommodated in a case (not shown). A common electric blower 19 blows air (air to be cooled) through an air passage defined in the case in the direction of arrow "F". The blown air is cooled by the two evaporators 15 and 18.

The cold air cooled by the two evaporators 15, 18 is sent into a common space to be cooled (not shown). This leads to cooling of the common space to be cooled by the two evaporators 15, 18. Among these two evaporators 15 and 18, the first evaporator 15 connected to a main flow path on the downstream side of the ejector 14 is disposed on the upstream side (windward side) of the air flow F, and the second evaporator 18 connected to the refrigerant suction port 14*b* of the ejector 14 is disposed on the downstream side (leeward side) of the air flow F.

When the refrigeration cycle device 10 of this embodiment is used for vehicle air conditioning, the space inside the vehicle compartment is the space to be cooled. When the refrigeration cycle device 10 of this embodiment is applied to a freezer car, a freezer and refrigerator space of the freezer car is the space to be cooled. The space to be cooled can be suitably changed in accordance with the use of the refrigeration cycle device 10.

In this embodiment, the ejector 14, the first and second evaporators 15, 18, and the throttle mechanism 17 are assembled as one integrated unit 20.

Now, concrete examples of this integrated unit 20 will be described with reference to FIGS. 2 to 5.

Figure 2:
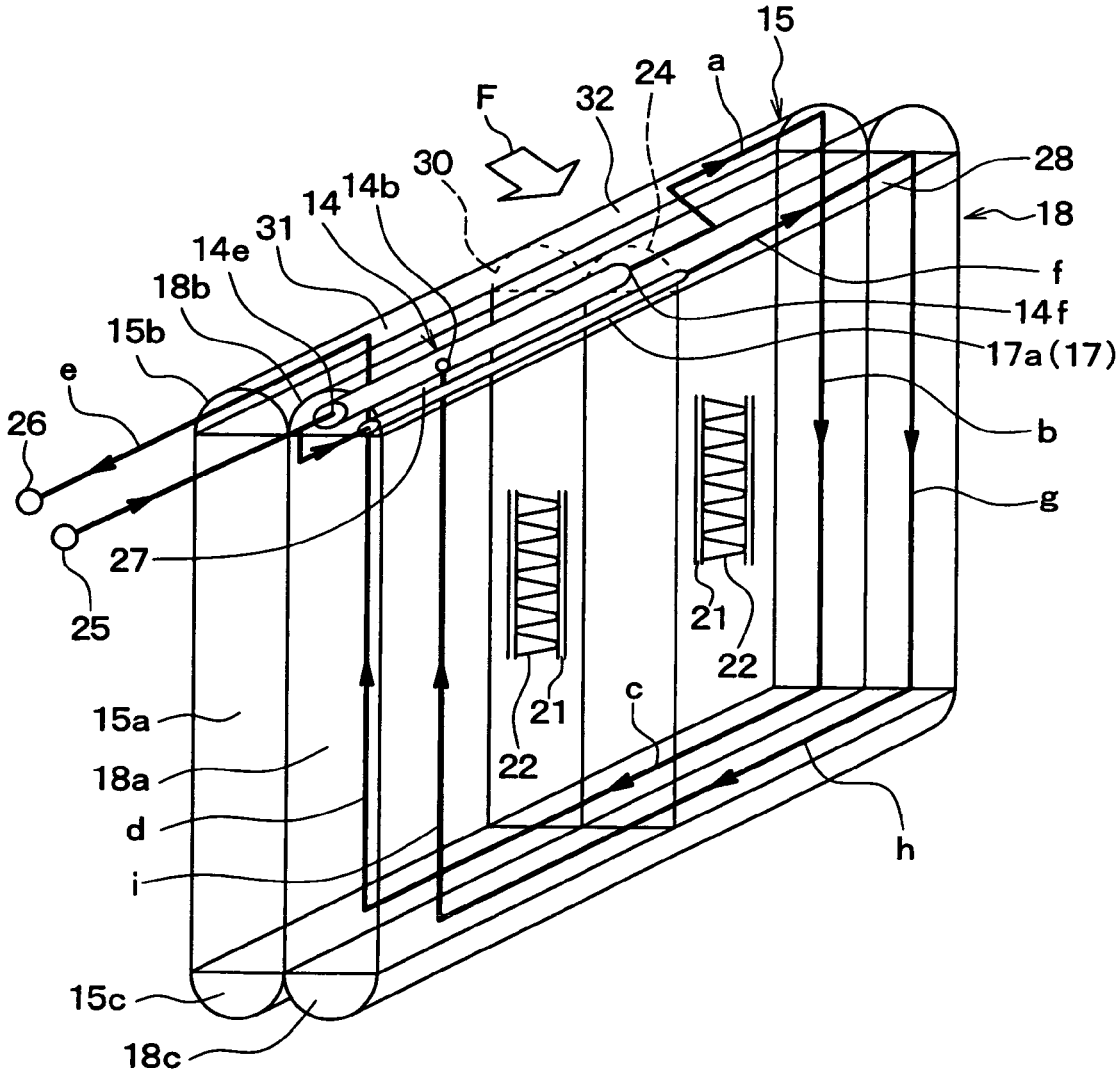
FIG. 2 is a perspective view schematically showing the structure of an integrated unit of the first embodiment.
Figure 3:
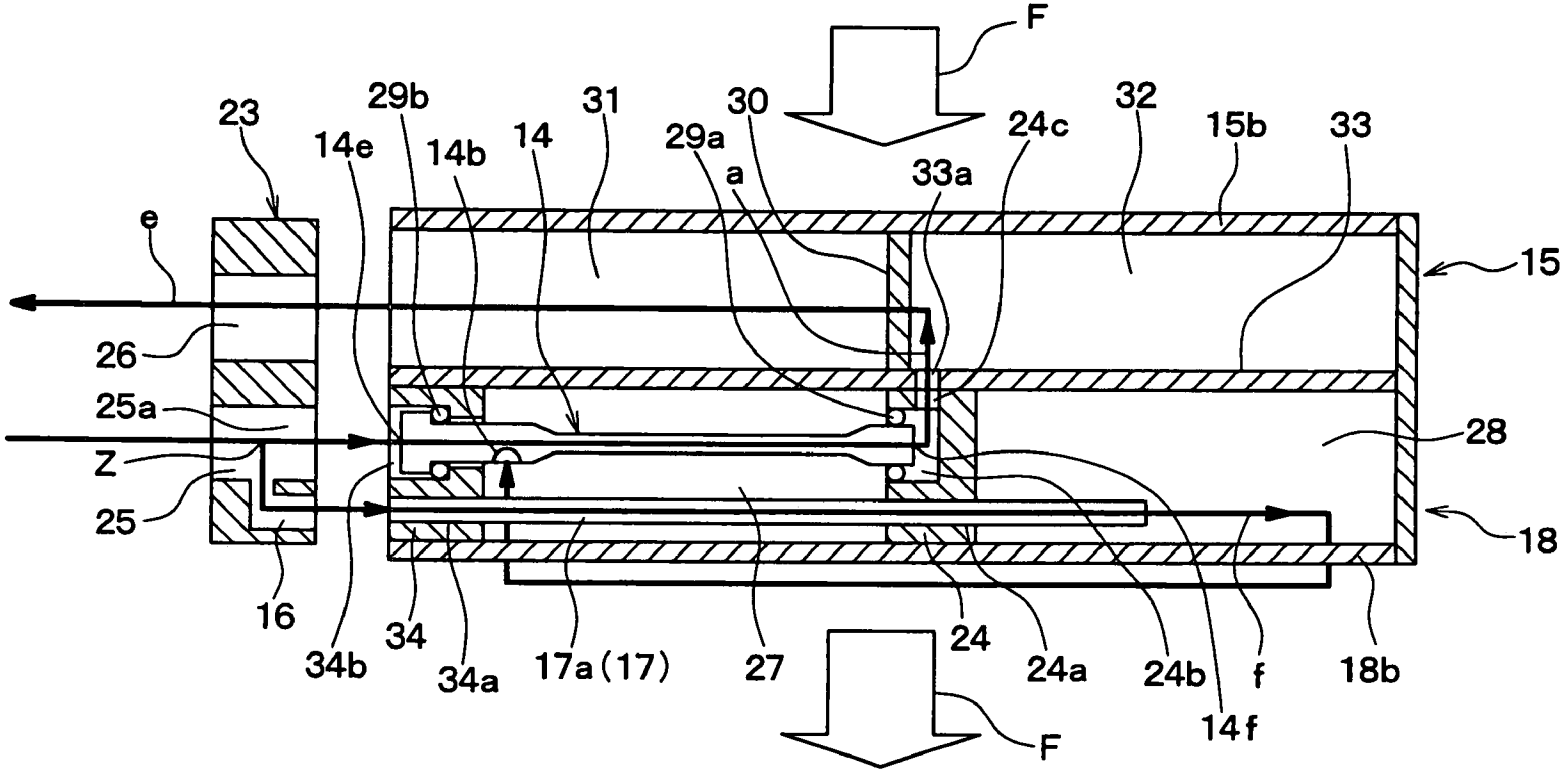
FIG. 3 is a sectional view of an evaporator tank of the integrated unit taken horizontally in FIG. 2.
Figure 4:
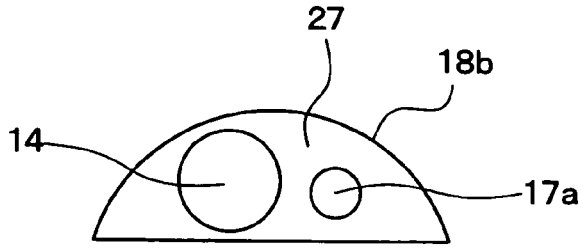
FIG. 4 is a sectional view of the evaporator tank of the integrated unit taken vertically in FIG. 2.
Figure 5:
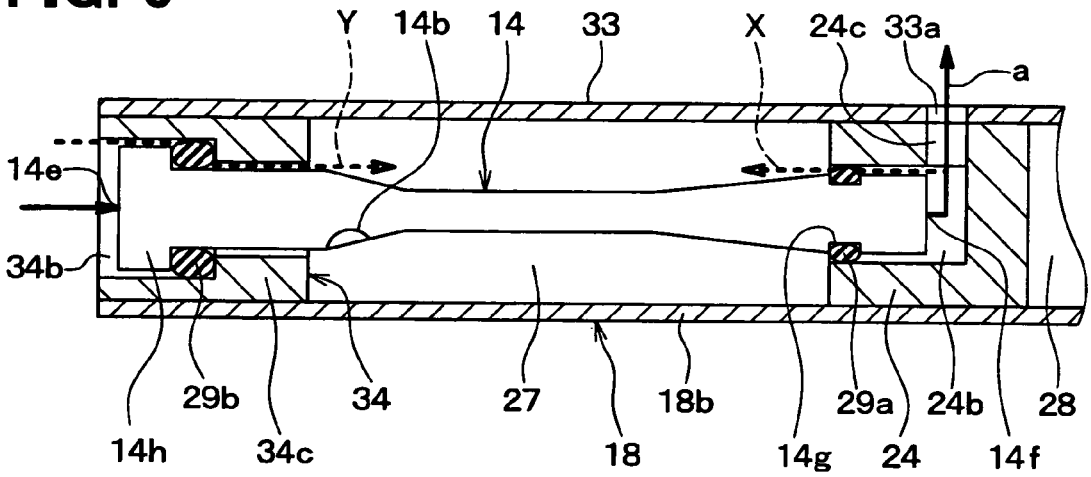
FIG. 5 is an enlarged sectional view of a part of the integrated unit shown in FIG. 2.

FIG. 2 is an exploded perspective view showing an outline of the entire structure of the integrated unit 20. FIG. 3 is a lateral sectional view of upper tanks of the first and second evaporators 15 and 18. FIG. 4 is a longitudinal sectional view of the upper tank of the second evaporator 18, and FIG. 5 is an enlarged sectional view showing a part of FIG. 3, in which the capillary tube 17*a* is not indicated.

Now, an example of the integrated structure including the two evaporators 15 and 18 will be explained with reference to FIG. 2. In the example shown in FIG. 2, the two evaporators 15 and 18 are completely integrated as one evaporator structure. Thus, the first evaporator 15 constructs an upstream side portion of the air flow F in the integrated one evaporator structure, and the second evaporator 18 constructs a downstream side portion of the air flow F in the integrated one evaporator structure.

The first evaporator 15 and the second evaporator 18 have the same basic structure, including heat-exchange core portions 15*a* and 18*a*, and tanks 15*b*, 15*c*, 18*b*, and 18*c* positioned on both upper and lower sides of the heat-exchange core portions 15*a* and 18*a*.

Each of the heat-exchange core portions 15*a* and 18*a* include a plurality of tubes 21 respectively extending vertically. Between these tubes 21, a passage is formed for allowing a heat-exchanged medium, that is, the air to be cooled in this embodiment, to pass therethrough.

Fins 22 are disposed between adjacent these tubes 21 in a stack direction of the tubes 21, and can be brazed to the tubes 21. Each of the heat-exchange core portions 15*a* and 18*a* is constructed of a stacked structure including the tubes 21 and the fins 22. These tubes 21 and fins 22 are alternately staked in the stack direction (e.g., the left/right or lateral direction of the heat-exchange core portions 15*a* and 18*a*). In another example, a structure without fins 22 can be employed.

Although FIG. 2 shows only parts of the fins 22, the fins 22 may be formed over the entire areas of the heat-exchange core portions 15*a* and 18*a*. The stacked structure including the tubes 21 and the fins 22 is formed over each of the entire areas of the heat-exchange core portions 15*a* and 18*a*. The blown air from the electric blower 19 passes through voids of the stacked structure.

The tube 21 constructs a refrigerant passage, and is constructed of a flat tube having a flat section elongated along the air flow direction A. The fin 22 is a corrugated fin formed by bending a thin plate in a wave-like shape, and is connected to the flat outer surface of the tube 21 to increase an air-side heat transmission area.

The tube 21 of the heat-exchange core portion 15*a* and the tube 21 of the heat-exchange core portion 18*a* respectively construct the refrigerant passages that are independent from each other. The tanks 15*b* and 15*c* on both upper and lower sides of the first evaporator 15, and the tanks 18*b* and 18*c* on both upper and lower sides of the second evaporator 18 construct the refrigerant passage spaces that are independent from each other.

Both the upper and lower ends of the tube 21 of the heat-exchange core portion 15*a* are inserted into the tanks 15*b* and 15*c* on both the upper and lower sides of the first evaporator 15. The tanks 15*b* and 15*c* have tube engagement holes 15*d* for connection. Both the upper and lower ends of the tube 21 are in communication with the inner spaces of the tanks 15*b* and 15*c*.

Similarly, both the upper and lower ends of the tube 21 of the heat-exchange core portion 18*a* are inserted into the tanks 18*b* and 18*c* on both the upper and lower sides of the second evaporator 18. The tanks 18*b* and 18*c* have tube engagement holes 18*d* for connection. Both the upper and lower ends of the tube 21 are in communication with the inner spaces of the tanks 18*b* and 18*c*.

Thus, the tanks 15*b*, 15*c*, 18*b*, and 18*c* on both the upper and lower sides serve to distribute the refrigerant into the respective tubes 21 of the heat-exchange core portions 15*a* and 18*a*, and to collect the refrigerant streams from the tubes 21.

The two upper tanks 15*b* and 18*b* as well as the two lower tanks 15*c* and 18*c* are adjacent to each other, and thus can be formed integrally. Alternatively, the two upper tanks 15*b* and 18*b*, and the two lower tanks 15*c* and 18*c* may be formed independently.

Aluminum which is a metal having excellent thermal conductivity and brazing property is suitable as specific material for components of the evaporator 15, 18, such as the tube 21, the fin 22, and the tanks 15*b*, 15*c*, 18*b* and 18*c*. Each component is formed using the aluminum material, so that all components of the first and second evaporators 15 and 18 can be assembled and connected integrally by brazing.

In this embodiment, first and second connection blocks 23, 24, a stopper member 34 and the capillary tube 17*a* or the like constituting the throttle mechanism 17 shown in FIG. 3 are integrally assembled to the first and second evaporators 15 and 18 by brazing.

On the other hand, since the ejector 14 has a fine passage formed in the nozzle portion 14*a* with high accuracy, when the ejector 14 is brazed, the nozzle portion 14*a* may be thermally deformed due to the high temperature in brazing (brazing temperature of aluminum: about 600 degrees). Unfortunately, this may not keep the shape and dimension of the passage in the nozzle portion 14*a* according to a predetermined design.

For this reason, after integrally brazing the first and second evaporators 15 and 18, the first and second connection blocks 23, 24, the stopper member 34 and the capillary tube 17*a*, the ejector 14 is assembled to the evaporator side.

More specifically, an assembly structure of the ejector 14, the capillary tube 17*a*, the first and second connection blocks 23 and 24, and the stopper member 34 will be described below. The capillary tube 17*a*, the first and second connection blocks 23 and 24, and the stopper member 34 are formed of aluminum material, like components of the evaporator. As shown in FIG. 3, the first connection block 23 is fixed by brazing to one side of each of the upper tanks 15*b* and 18*b* of the first and second evaporators 15 and 18 in the longitudinal direction. The first connection block 23 includes one refrigerant inlet 25 and one refrigerant outlet 26 of the integrated unit 20 shown in FIG. 1.

The refrigerant inlet 25 is branched at the midway point of the first connection block 23 in the thickness direction into a main passage 25*a* serving as a first passage directed toward an inlet of the ejector 14 (the refrigerant flow inlet 14*e* of the nozzle portion 14*a*), and a branch passage 16 serving as a second passage directed toward an inlet of the capillary tube 17*a*. This part of the branch passage 16 corresponds to an inlet portion of the branch passage 16 shown in FIG. 1. Thus, the branch point z shown in FIG. 1 is formed inside the first connection block 23.

In contrast, the refrigerant outlet 26 is constructed of one simple passage hole (circular hole or the like) penetrating the first connection block 23 in the thickness direction.

The branch passage 16 of the first connection block 23 is sealed and connected to one end of the capillary tube 17*a* (to the left end thereof shown in FIGS. 2 and 3) by brazing.

The second connection block 24 is disposed in the substantially center of an internal space of the upper tank 18*b* of the second evaporator 18 in the longitudinal direction, and brazed to the inner wall surface of the upper tank 18*b*. The second connection block 24 serves to partition the internal space of the upper tank 18*b* into two spaces in the longitudinal direction of the tank, namely, a left space 27 and a right space 28. The left space 27 corresponds to the internal space in the invention.

The stopper member 34 is disposed on the end of the internal space of the upper tank 18*b* of the second evaporator 18 on the first connection block 23 side, and brazed to the inner wall surface of the upper tank 18*b*. The stopper member 34 serves to restrict the position of the ejector 14 in the longitudinal direction.

One end of the capillary tube 17*a* (left end shown in FIGS. 2 and 3) is in communication with the branch passage 16 of the first connection block 23 through a support hole 34*a* of the stopper member 34. The other end of the capillary tube 17*a* (right end shown in FIGS. 2 and 3) is opened to the inside of the right space 28 of the upper tank 18*b* through a support hole 24*a* of the second connection block 24.

A gap between the outer peripheral surface of the capillary tube 17*a* and the support hole 24*a* is sealed by brazing, so that a gap between both left and right spaces 27 and 28 remains interrupted. A gap between the outer peripheral surface of the capillary tube 17*a* and the support hole 34*a* is sealed by brazing.

The nozzle portion 14*a* of the ejector 14 is formed of stainless, brass, or the like. The other parts except for the nozzle portion 14*a* (a housing portion for forming the refrigerant suction port 14*b*, the mixing portion 14*c*, the diffuser 14*d*, and the like) are made of metallic material, such as copper or aluminum, but may be made of resin (non-metallic material).

The ejector 14 is inserted into the upper tank 18*b* through the refrigerant inlet 25 of the first connection block 23 and the hole of the main passage 25*a* after completion of an assembling step of integrally brazing the first and second evaporators 15 and 18, and the like (brazing step).

That is, the ejector 14 is disposed in parallel to the upper tank 18*b*, and has its longitudinal direction identical to the longitudinal direction of the upper tank 18*b*.

The tip of the ejector 14 in the longitudinal direction (the end thereof on the refrigerant discharge port 14*f* side) is inserted into a circular recess 24*b* of the second block 24, and is sealed and fixed thereto using the first O-ring 29*a*. The tip of the ejector is in communication with a communication hole 24*c* of the second connection block 24.

The first O-ring 29*a* corresponds to the first vibration-isolating seal member in the invention, and is formed of thermoplastic elastomer (NBR in this example). The thermoplastic elastomer has rubber elasticity at room temperature, and is melted to exhibit fluidity when heated at a high temperature. The thermoplastic elastomer is a material that can be used for injection molding, like a thermoplastic resin. The first O-ring 29*a* is held by a groove 14g of the ejector 14 (see FIG. 5) to form a cylindrical seal mechanism.

A clearance having a predetermined dimension is provided between the outer peripheral surface of the tip of the ejector and the inner peripheral surface of the circular recess 24*b* of the second connection block 24, so that the outer peripheral surface of the ejector tip is not brought into direct contact with the inner peripheral surface of the second connection block 24.

A partition plate 30 is disposed substantially in the center of the internal space of the upper tank 15*b* of the first evaporator 15 in the longitudinal direction (see FIG. 3). The partition plate 30 partitions the internal space of the upper tank 15*b* into two spaces in the longitudinal direction, namely, a left space 31 and a right space 32.

The communication hole 24*c* of the second connection block 24 is in communication with the right space 32 of the upper tank 15*b* of the first evaporator 15 via a through hole 33*a* of an intermediate wall surface 33 of both upper tanks 15*b* and 18*b*. The left end of the ejector 14 in the longitudinal direction (the end of the nozzle portion 14*a* on the refrigerant flow inlet 14*e* side) is inserted into an ejector insertion hole 34*b* of the stopper member 34, and sealed and fixed thereto using the second O-ring 29*b*.

The second O-ring 29*b* corresponds to second vibration-isolating seal member of the invention, and is made of thermoplastic elastomer (NBR in this embodiment), like the first O-ring 29*a*.

The ejector 14 is fixed at a certain position in the longitudinal direction by an engagement structure between the ejector 14 and the upper tank 18*b*. More specifically, the ejector 14 has an ejector side protrusion 14*h* (see FIG. 5) formed on the left end thereof in the longitudinal direction and protruding in an annular shape toward the inner wall surface of the ejector insertion hole 34*b*. In contrast, the stopper member 34 of the upper tank 18*b* has a tank side protrusion 34*c* formed to protrude in an annular shape from the inner wall surface of the ejector insertion hole 34*b* toward the ejector 14.

The ejector side protrusion 14*h* is engaged with the tank side protrusion 34*c* from the ejector upstream side (the left side shown in FIG. 5) to the ejector downstream side (the right side shown in FIG. 5) to fix the ejector 14 in the certain position in the longitudinal direction.

The second O-ring 29*b* is sandwiched and held between both protrusions 14*h* and 34*c*. In short, the ejector side protrusion 14*h* is engaged with the tank side protrusion 34*c* via the second O-ring 29*b*.

Thus, the second O-ring 29*b* forms a plane seal mechanism by being elastically-compressed between both the protrusions 14*h* and 34*c*.

A clearance having a predetermined dimension is provided between the outer. peripheral surface of the left end of the ejector and the inner wall surface of the ejector insertion hole 34*b* of the stopper member 34, so that the outer peripheral surface of the left end of the ejector is not brought into direct contact with the inner peripheral surface of the ejector insertion hole 34*b* of the stopper member 34.

Figure 6A:
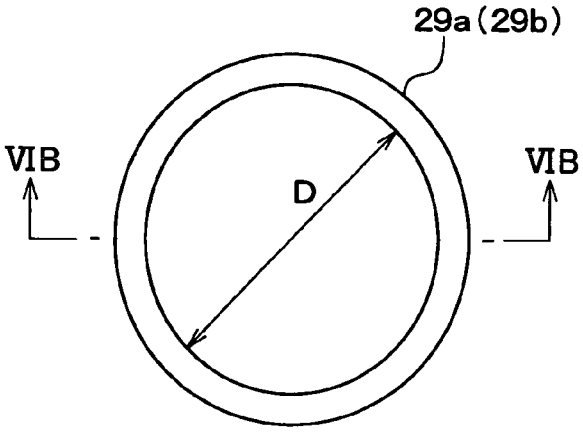
FIG. 6A is a plan view of a first O-ring of the first embodiment.
Figure 6B:
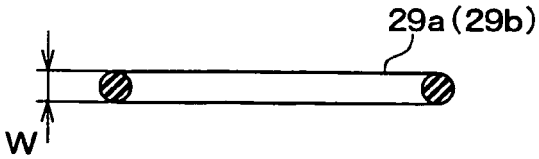
FIG. 6B is a sectional view taken along the line VIB-VIB in FIG. 6A.

FIG. 6A is a plan view of the first O-ring 29*a*, and FIG. 6B is a sectional view taken along the line VIB-VIB in FIG. 6A. The shape of the second O-ring 29*b* is the same as that of the first O-ring 29*a*. Thus, the reference numeral inside the parenthesis in FIG. 6 indicates the second O-ring 29*b*, and thus the representation of the second O-ring 29*b* will be omitted in the figure.

As shown in FIG. 6B, the shape of the cross section of each of the first and second O-rings 29*a* and 29*b* taken along a plane perpendicular to the circumferential direction thereof (hereinafter referred to as a sectional shape of each of the first and second O-rings 29*a* and 29*b*) is circular.

In this embodiment, the first O-ring 29*a* is set to have a wire diameter W of 1.9 mm, an inner diameter D of 7.8 mm, and a hardness of 50. The second O-ring 29*b* is set to have a wire diameter W of 1.9 mm, an inner diameter D of 8.8 mm, and a hardness of 70. That is, the hardness of the first O-ring 29*a* is lower than that of the second O-ring 29*b*.

As shown in FIG. 3, the first connection block 23 is brazed to the side walls of the upper tanks 15*b* and 18*b* such that the refrigerant outlet 26 is in communication with the left space 31 of the upper tank 15*b*, the main passage 25*a* is in communication with the left space 27 of the upper tank 18*b*, and the branch passage 16 is in communication with one end of the capillary tube 17*a*. The refrigerant suction port 14*b* of the ejector 14 is in communication with the left space 27 of the upper tank 18*b* of the second evaporator 18.

In this embodiment, the inside of the upper tank 18*b* of the second evaporator 18 is partitioned into the left and right spaces 27 and 28 by the second connection block 24. The left space 27 serves as a collection tank (collection space) for collecting the refrigerant from the tubes 21, and the right space 28 serves as a distribution tank (distribution space) for distributing the refrigerant among the tubes 21.

This arrangement can position the ejector 14 and the evaporator 18 in a compact manner, and further make the body of the entire unit compact. Moreover, the ejector 14 is disposed in the left space 27 serving as the collection tank, and the refrigerant suction port 14*b* is set to be opened directly to the inside of the left space 27 serving as the collection tank. This arrangement can decrease the number of refrigerant pipes.

This arrangement provides an advantage that collection of the refrigerant from the tubes 21 and supply of the refrigerant to the ejector 14 (suction of the refrigerant) can be achieved by only one tank.

In this embodiment, the first evaporator 15 is disposed adjacent to the second evaporator 18, and the end of the ejector 14 on the downstream side is disposed adjacent to the distribution tank of the first evaporator 15 (the right space 32 of the upper tank 15). This arrangement provides an advantage that the refrigerant flowing from the ejector 14 can be supplied to the first evaporator 15 side through a simple short refrigerant passage (via holes 24*c* and 33*a*) even when the ejector 14 is incorporated in the tank of the second evaporator 18.

The refrigerant flow paths of the entire integrated unit 20 with the above-mentioned arrangement will be specifically described below with reference to FIGS. 2 and 3. The refrigerant inlet 25 of the first connection block 23 is branched into the main passage 25*a* and the branch passage 16. The refrigerant in the main passage 25*a* is first decompressed through the ejector 14 (from the nozzle portion 14*a* to the mixing portion 14*c*, and further the diffuser 14*d*). Thereafter, the low-pressure refrigerant decompressed flows into the right space 32 of the upper tank 15*b* of the first evaporator 15 through the communication hole 24*c* of the second connection block 24 and the through hole 33*a* of the intermediate wall surface 33 as indicated by the arrow "a".

The refrigerant in the right space 32 descends the tubes 21 on the right side of the heat-exchange core portion 15*a* as indicated by the arrow "b", and then flows into the right side of the lower tank 15*c*. Since no partition plate is provided in the lower tank 15*c*, the refrigerant moves from the right side of the lower tank 15*c* to the left side thereof as indicated by the arrow "c".

The refrigerant on the left side of the lower tank 15*c* rises through the tubes 21 on the left side of the heat-exchange core portion 15*a* as indicated by the arrow "d", and then flows into the left space 31 of the upper tank 15*b*. Further, the refrigerant therefrom flows into the refrigerant outlet 26 of the first connection block 23 as indicated by the arrow "e".

On the other hand, the refrigerant in the branch passage 16 of the first connection block 23 is first decompressed through the capillary tube 17*a*. The decompressed low-pressure refrigerant flows into the right space 28 of the upper tank 18*b* of the second evaporator 18 as indicated by the arrow "f".

The refrigerant flowing into the right space 28 descends the tubes 21 on the right side of the heat-exchange core portion 18*a* as indicated by the arrow "g", and then flows into the right side of the lower tank 18*c*. Since no partition plate is provided in the lower tank 18*c*, the refrigerant moves from the right side of the lower tank 18*c* to the left side thereof as indicated by the arrow "h".

The refrigerant on the left side of the lower tank 18*c* rises through the tubes 21 on the left side of the heat-exchange core portion 18*a* as indicated by the arrow "i", and then flows into the left space 27 of the upper tank 18*b*. Since the refrigerant suction port 14*b* of the ejector 14 is in communication with the left space 27, the refrigerant in the left space 27 is drawn from the refrigerant suction port 14*b* into the ejector 14.

Referring to FIG. 3, the refrigerant suction port 14*b* is disposed so as to be directed toward the side wall of the upper tank 18*b* (toward the lower side of the tank 18*b* shown in FIG. 3), but may be disposed so as to be directed toward the tube 21 (toward the back side of the paper surface shown in FIG. 3).

The integrated unit 20 has the structure of the refrigerant flow paths as mentioned above. Thus, only one refrigerant inlet 25 may be provided in the first connection block 23 in the entire integrated unit 20, and only one refrigerant outlet 26 may also be provided in the first connection block 23.

Now, the operation of the first embodiment will be described below. When the compressor 11 is driven by the vehicle engine, the high-temperature and high-pressure refrigerant compressed and discharged by the compressor 11 flows into the radiator 12. The high-temperature refrigerant is cooled and condensed by the outside air in the radiator 12. The high-pressure refrigerant flowing from the radiator 12 flows into the liquid receiver 12*a*, in which the refrigerant is separated into gas and liquid phases. The liquid refrigerant is guided from the liquid receiver 12*a* to pass through the thermal expansion valve 13.

The thermal expansion valve 13 has an opening degree of valve (refrigerant flow amount) adjusted such that a degree of superheat of the refrigerant at the outlet of the first evaporator 15 (i.e., the refrigerant drawn into the compressor) is a predetermined value thereby to decompress the high-pressure refrigerant. The refrigerant having passed through the thermal expansion valve 13 has an intermediate pressure, and flows into the one refrigerant inlet 25 provided in the first connection block 23 of the integrated unit 20.

The refrigerant flow is divided into a refrigerant stream directed from the main passage 25*a* of the first connection block 23 to the nozzle portion 14*a* of the ejector 14, and a refrigerant stream directed from the refrigerant branch passage 16 of the first connection block 23 to the capillary tube 17*a*.

The refrigerant flow entering the nozzle portion 14*a* of the ejector 14 is decompressed and expanded by the nozzle portion 14*a*. Thus, the pressure energy of the refrigerant is converted to the velocity energy thereof at the nozzle portion 14*a*. The refrigerant from an ejection port of the nozzle portion 14*a* is ejected at high velocity. The decrease in refrigerant pressure at the ejection time sucks the refrigerant (gas-phase refrigerant) having passed through the second evaporator 18 of the branch refrigerant passage 16 from the refrigerant suction port 14*b*.

The refrigerant ejected from the nozzle portion 14*a* and the refrigerant drawn into the refrigerant suction port 14*b* are mixed by the mixing portion 14*c* disposed on the downstream side of the nozzle portion 14*a* to flow into the diffuser 14*d*. The velocity (expansion) energy of the refrigerant is converted to the pressure energy thereof by enlarging the passage area in the diffuser 14*d*, resulting in an increased pressure of the refrigerant.

The refrigerant flowing from the diffuser 14*d* of the ejector 14 flows through the refrigerant flow paths in the first evaporator 15 as indicated by the arrows "a" to "e" of FIG. 2. During this time, in the heat-exchange core portion 15*a* of the first evaporator 15, the low-temperature and low-pressure refrigerant absorbs heat from the blown air indicated by the arrow "F" to evaporate. The gas-phase refrigerant after evaporation is drawn from the one refrigerant outlet 26 into the compressor 11, and compressed again by the compressor 11.

In contrast, the refrigerant flow entering the refrigerant branch passage 16 is decompressed by the capillary tube 17*a* to be low-pressure refrigerant (gas-liquid two-phase refrigerant), which flows through the refrigerant flow paths in the second evaporator 18 as indicated by the arrows "f" to "i" of FIG. 2. During this time, in the heat-exchange core portion 18*a* of the second evaporator 18, the low-temperature and low-pressure refrigerant absorbs heat from the blown air having passed through the first evaporator 15 to evaporate. The gas-phase refrigerant after evaporation is drawn from the refrigerant suction port 14*b* into the ejector 14.

As mentioned above, according to this embodiment, the refrigerant on the downstream side of the diffuser 14*d* of the ejector 14 can be supplied to the first evaporator 15, while the refrigerant on the branch passage 16 side can be supplied to the second evaporator 18 through the capillary tube (throttle mechanism) 17*a*, so that the first and second evaporators 15 and 18 can exhibit the cooling effect at the same time. Thus, the cold air cooled by both the first and second evaporators 15 and 18 is blown off into the space to be cooled, thereby refrigerating (cooling) the space to be cooled.

At this time, the refrigerant evaporation pressure of the first evaporator 15 is a pressure of the refrigerant whose pressure is increased by the diffuser 14*d*. In contrast, since the outlet side of the second evaporator 18 is connected to the refrigerant suction port 14*b* of the ejector 14, the lowest pressure of the refrigerant directly after the decompression by the nozzle portion 14*a* can be applied to the second evaporator 18.

Thus, the refrigerant evaporation pressure (refrigeration evaporation temperature) of the second evaporator 18 can be lower than that of the first evaporator 15. The first evaporator 15 whose refrigerant evaporation temperature is higher is disposed on the upstream side with respect to the flow direction "F" of the blown air, while the second evaporator 18 whose refrigerant evaporation temperature is lower is disposed on the downstream side. This can ensure both a difference between the refrigerant evaporation temperature of the first evaporator 15 and the temperature of the blown air, and a difference between the refrigerant evaporation temperature of the second evaporator 18 and the temperature of the blown air.

Thus, both the first and second evaporators 15 and 18 can effectively exhibit cooling capacities. Therefore, the cooling capacity for the common space to be cooled can be improved effectively by the combination of the first and second evaporators 15 and 18. The suction pressure of the compressor 11 can be increased by a pressure increasing effect of the diffuser 14*d* to decrease a driving power of the compressor 11.

Next, the operation and effect of the refrigeration cycle device according to the first embodiment will be described.

(1) The first evaporator 15 whose refrigerant evaporation temperature is high is disposed on the upstream side with respect to the flow direction F of the blown air, and the second evaporator 18 whose refrigerant evaporation temperature is low is disposed on the downstream side. This can ensure both a difference between the refrigerant evaporation temperature and the temperature of the blown air in the first evaporator 15, and a difference between the refrigerant evaporation temperature and the temperature of the blown air in the second evaporator 18. Thus, the combination of the first and second evaporators 15 and 18 can effectively improve cooling capability of a common space of interest to be cooled.

(2) The suction pressure of the compressor 11 is increased by a pressurization effect of the diffuser 14*d*, which can decrease a driving power of the compressor 11.

(3) The flow rate of refrigerant on the second evaporator 18 side can be independently adjusted by the capillary tube (throttle mechanism) 17 without being dependent on the function of the ejector 14. The flow rate of refrigerant into the first evaporator 15 can be adjusted by throttle characteristics of the ejector 14. Thus, the flow rates of the refrigerant into the first and second evaporators 15 and 18 can be easily adjusted according to respective thermal loads.

(4) Since the refrigerant branch passage 16 has a relationship of connection in parallel to the ejector 14, the refrigerant can be supplied to the refrigerant branch passage 16 using not only refrigerant suction capability of the ejector 14 but also refrigerant suction and discharge capability of the compressor 11. This makes it easy to ensure the cooling capability of the second evaporator 18 even under a low thermal load condition.

(5) In mounting the refrigeration cycle device 10 on a vehicle, the work for connection of pipes can be completed only by connecting one refrigerant inlet 25 to the outlet side of the expansion valve 13, and one refrigerant outlet 26 to the suction side of the compressor 11 in the entire integrated unit 20 incorporating therein the above-mentioned various components (14, 15, 18, 17*a*).

(6) As shown in FIG. 2, the body of the entire integrated unit 20 can be made small and simple, which can reduce a mounting space. Thus, mounting performance of the refrigeration cycle device 10 including the evaporators 15 and 18 on the vehicle becomes very satisfactory, and the number of components of the cycle can be decreased, which enables reduction in cost.

(7) The length of a connection passage between various components (14, 15, 18, 17*a*) can be reduced to a small value. Thus, the loss in pressure of the refrigerant flow path can be decreased, and at the same time the heat exchange between the low-pressure refrigerant and the environmental atmosphere can be effectively reduced. This can improve the cooling capability of the first and second evaporators 15 and 18.

In this embodiment, the tip of the ejector and the second connection block 24 are sealed and fixed to each other using the first O-ring 29*a*, so that the refrigerant discharged from the refrigerant discharge port 14*f* of the ejector 14 can be prevented from leaking into the left space 27 of the upper tank 18*b* as indicated by the arrow X with the broken line shown in FIG. 5.

Likewise, the left end of the ejector is sealed and fixed to the stopper member 34 using the second O-ring 29*b*, so that the refrigerant flowing into the refrigerant flow inlet 14*e* of the ejector 14 can be prevented from leaking into the left space 27 of the upper tank 18*b* as indicated by the arrow Y with the broken line shown in FIG. 5.

The refrigerant flowing into the refrigerant flow inlet 14*e* of the ejector 14 is refrigerant whose pressure is relatively high before being decompressed by the ejector 14. In contrast, the refrigerant discharged from the refrigerant discharge port 14*f* of the ejector 14 is refrigerant whose pressure is relatively low after being decompressed by the ejector 14. Thus, the seal capability required for the first O-ring 29*a* is lower than that required for the second O-ring 29*b*.

From this viewpoint, in this embodiment, the hardness of the first O-ring 29*a* is lower than that of the second O-ring 29*b*, whereby the seal capability of the first O-ring 29*a* is lower than that of the second O-ring 29*b*.

Since the first O-ring 29*a* can improve the vibration isolation capability as it decreases the hardness, the transmission of vibration of the ejector 14 to the upper tank 18*b* and further to the second evaporator 18 can be suppressed by the first O-ring 29*a*.

As mentioned above, the unit for the refrigeration cycle device of this embodiment can suppress the transmission of vibration from the ejector 14 to the second evaporator 18, while ensuring the seal capability, thereby reducing the radiated sound generated from the second evaporator 18.

The detailed studies by the inventors of the present application show that setting the hardness of the first O-ring 29*a* in a range of 60-80% of the hardness of the second O-ring 29*b* can exhibit the good effect described above.

In this embodiment, the ejector 14 is not in metallic contact with the upper tank 18*b*, and held only by elastic contact via the first and second O-rings 29*a* and 29*b*. This can further suppress the transmission of vibration from the ejector 14 to the upper tank 18*b*, thereby reducing the radiated sound generated from the second evaporator 18.

Figure 7:
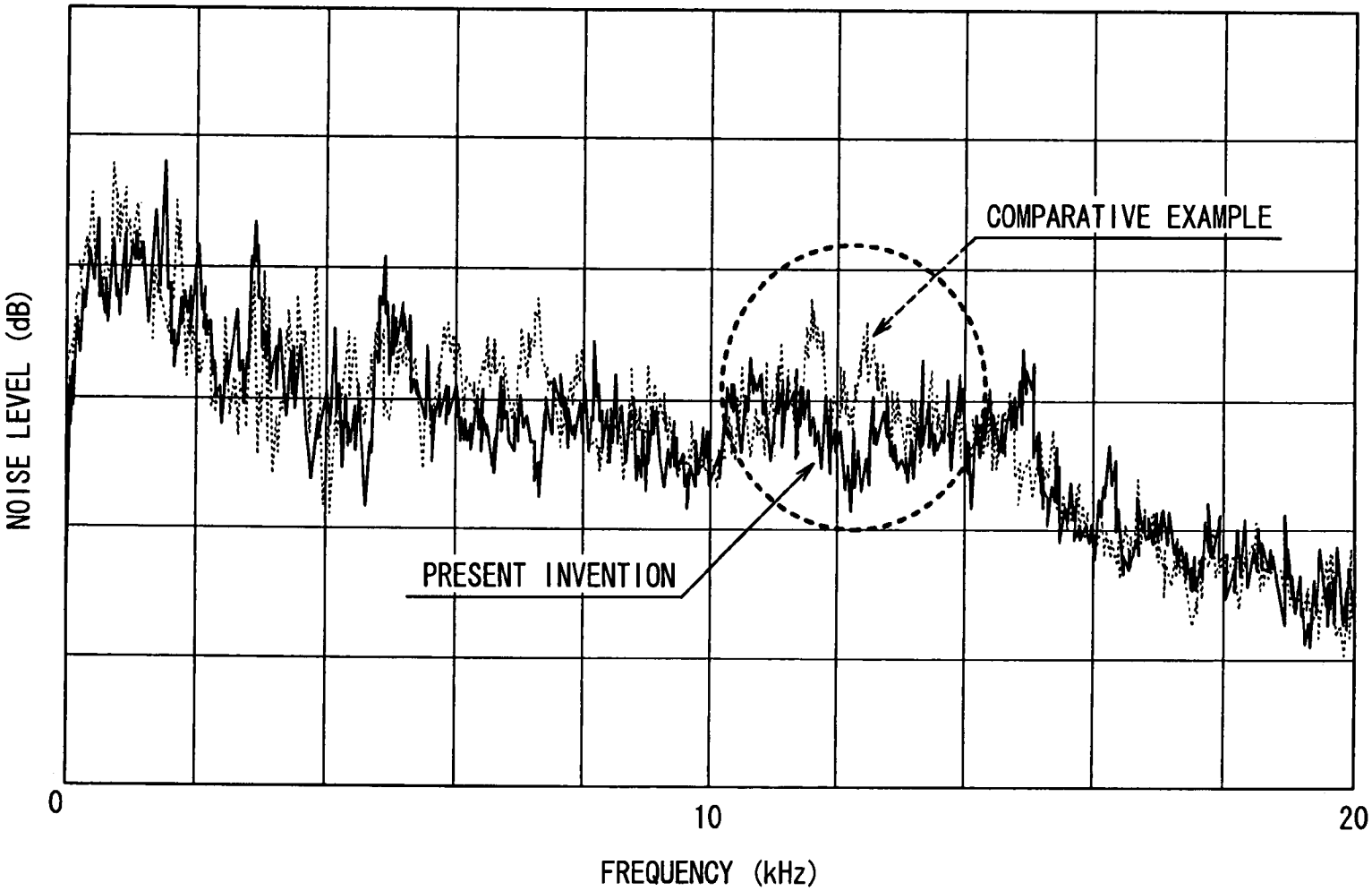
FIG. 7 is a graph showing the result of measurement of radiated sound (noise level) generated from a second evaporator.

FIG. 7 is a graph showing this effect, showing the result of measurement of radiated sounds (noise level) generated from the second evaporator 18 by a microphone disposed on the front side of the heat-exchange core portion 18*a* of the second evaporator 18.

In FIG. 7, the solid line shows the result of measurement in this embodiment of the present invention, and the dotted line shows the result of measurement in a comparative example. This comparative example differs from this embodiment in that the ejector 14 is fixed to the upper tank 18*b* by a screw, that is, the ejector 14 is in metallic contact with the upper tank 18*b*.

As can be seen from FIG. 7, this embodiment can reduce the radiated sound generated from the second evaporator 18 as compared to the comparative example. In particular, the effect of reducing the radiated sound can be obtained in a portion enclosed by the broken line in FIG. 7, or in a frequency area that has a large influence on auditory sense. This effect is large in the auditory sense.

The ejector 14 is not in metallic contact with the upper tank 18*b*, which can provide the effect of avoiding fatigue breakdown of the components due to the wear.

As mentioned above, since the pressure of refrigerant flowing into the refrigerant flow inlet 14*e* of the ejector 14 is higher than that of refrigerant discharged from the refrigerant discharge port 14*f* of the ejector 14, this pressure difference causes a force for pushing the ejector 14 toward the tip side of the ejector (the right side shown in FIGS. 4 and 5).

Thus, like this embodiment, the ejector 14 is held only by elastic contact via the first and second O-rings 29*a* and 29*b* without being fixed by screws. In this case, a mechanism is required which prevents the position of the ejector 14 in the longitudinal direction from deviating toward the ejector tip side due to the pressure difference between the upstream and downstream sides of the ejector 14.

From this viewpoint, in this embodiment, the ejector 14 is fixed in the certain position in the longitudinal direction by the engagement structure including the ejector side protrusion 14*h* and the tank side protrusion 34*c*. Thus, the ejector 14 can surely be fixed in the certain position in the longitudinal direction in spite of being held only by the elastic contact.

Since the ejector side protrusion 14*h* is engaged with the tank side protrusion 34*c* via the second O-ring 29*b* in the engagement structure, the second O-ring 29*b* is elastically compressed between the ejector side protrusion 14*h* and the tank side protrusion 34*c*, and thus can surely exhibit the seal capability.

This engagement structure can be made simple as compared to a structure in which the-ejector 14 is fixed in the certain position in the longitudinal direction using screw fixing means.

(Second Embodiment)

Figure 8:
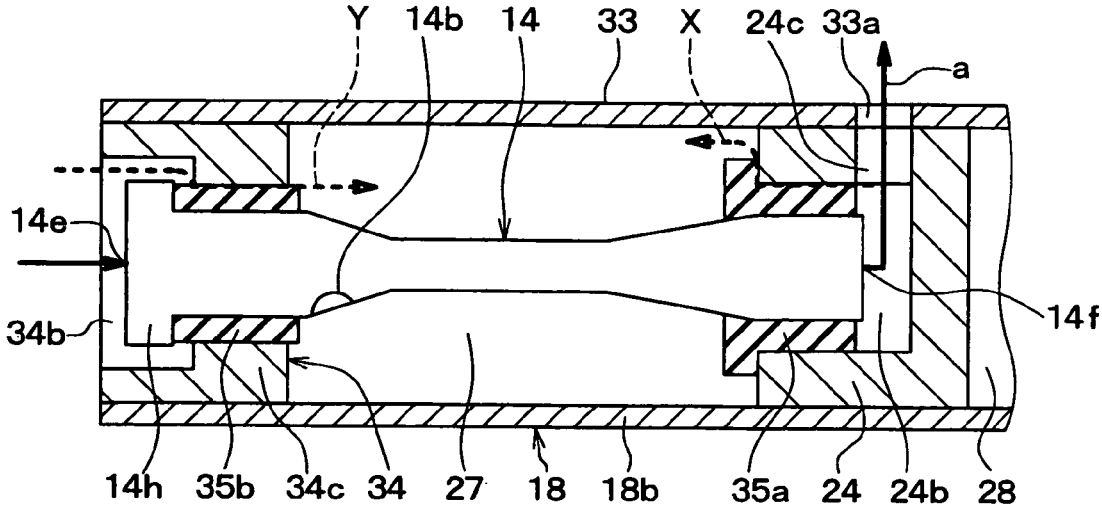
FIG. 8 is a sectional view showing a part of an integrated unit according to a second embodiment of the invention.

In the first embodiment, the first and second O-rings 29*a* and 29*b* having the above structure have the seal capability and the vibration isolation capability. However, in a second embodiment as shown in FIG. 8, first and second cylindrical seal members 35*a* and 35*b* exhibit the seal capability and the vibration isolation capability, instead of the first and second O-rings 29*a* and 29*b*.

The first cylindrical seal member 35*a* corresponds to first vibration isolating seal member of the invention. The second cylindrical seal member 35*b* corresponds to second vibration isolating seal member of the invention.

The first and second cylindrical seal members 35*a* and 35*b* are made of thermoplastic elastomer (NBR in this embodiment), like the first and second O-rings 29*a* and 29*b*. Furthermore, the hardness of the first cylindrical seal member 35*a* is set in a range of 60-80% of the hardness of the second cylindrical seal member 35*b*.

The first cylindrical seal member 35*a* is disposed between the outer peripheral surface of the tip of the ejector 14 and the inner peripheral wall surface of the circular recess 24*b* of the second connection block 24. The cylindrical seal member 35*a* has a flange formed to protrude radially outward in an annular shape. The flange is engaged with the second connection block 24 from the upstream side (the left side shown in FIG. 8) to the downstream side (the right side shown in FIG. 8) of the ejector.

Therefore, in this embodiment, the cylindrical seal member 35*a* and the second connection block 24 form an engagement structure for fixing the ejector 14 in the certain position in the longitudinal direction.

The second cylindrical seal member 35*b* is disposed between the outer peripheral surface of the left end of the ejector and the inner wall surface of the ejector insertion hole 34*b* of the stopper member 34.

The first and second cylindrical seal members 35*a* and 35*b* are previously assembled to the ejector 14, and then the ejector 14 is inserted into the upper tank 18*b*, so that the first and second cylindrical seal members 35*a* and 35*b* can be assembled to the predetermined positions.

In the second embodiment, the other parts may be similar to those of the above-described first embodiment. Therefore, the second embodiment can also obtain the same operation and effect as those of the first embodiment.

(Third Embodiment)

Figure 9:
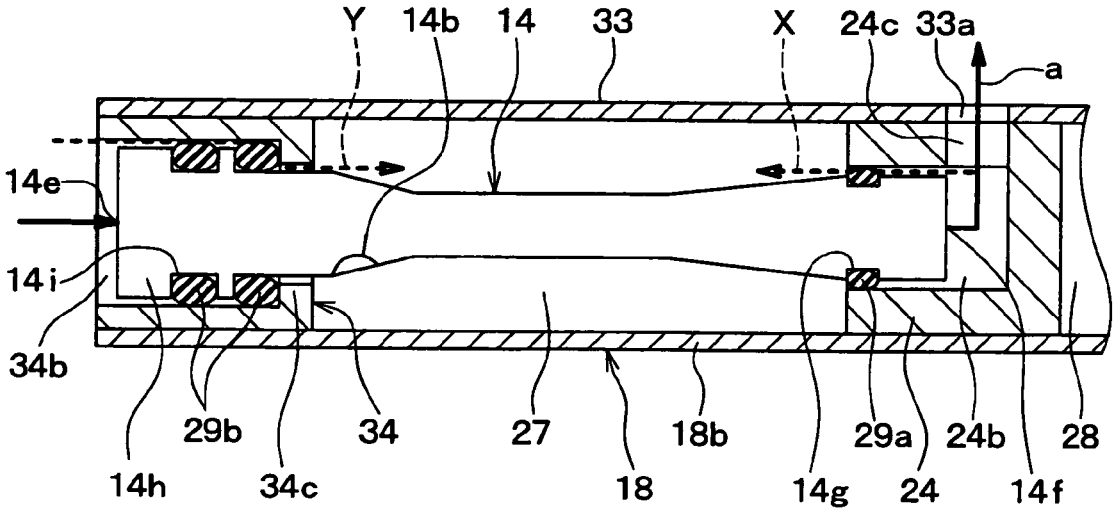
FIG. 9 is a sectional view showing a part of an integrated unit according to a third embodiment of the invention.

In the first embodiment, the first and second O-rings 29*a* and 29*b* with different hardness are disposed one by one. On the other hand, in a third embodiment, as shown in FIG. 9, the first and second O-rings 29*a* and 29*b* are set to have the same hardness, only the one first O-ring 29*a* is arranged, and second O-rings 29*b* (e.g., two) are arranged in the longitudinal direction of the ejector 14.

That is, a second elastic seal mechanism in this embodiment of the invention can be constructed of a plurality of elastic members (e.g., second O-rings 29*b*), and a first elastic seal mechanism of the invention can be constructed of elastic members (e.g., first O-rings 29*a*) the number of which is smaller than that of the elastic members of the second elastic seal mechanism.

The initial second O-ring 29*b* is sandwiched and held between the ejector side protrusion 14*h* and the tank side protrusion 34*c*, like the first embodiment. In contrast, the next second O-ring 29*b* is held by a groove 14*i* of the ejector side protrusion 14*h*.

In this embodiment, the hardness of each of the first and second O-rings 29*a* and 29*b* is set to 50. This makes it easy to manage the manufacturing and quality of the first and second O-rings 29*a* and 29*b* as compared to a case in which these O-rings are set to have different hardnesses.

In contrast, the hardness of the second O-ring 29*b* is low as compared to the first embodiment in which the hardness of the second O-ring 29*b* is set to 70, which reduces the seal capability. However, the two second O-rings 29*b* are arranged in the longitudinal direction of the ejector 14. That is, the number of the second O-rings 29*b* is increased to obtain the same seal capability as that in the first embodiment.

When three or more second O-rings 29*b* are arranged and the number of the first O-rings 29*a* disposed is smaller than that of the second O-rings 29*b*, it is apparent that the same operation and effect can also be obtained.

(Fourth Embodiment)

Figure 10:
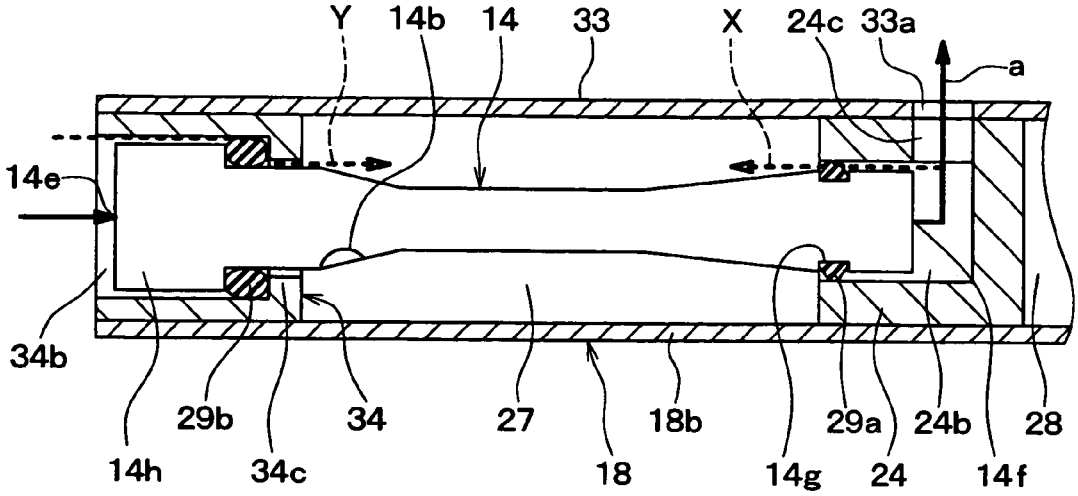
FIG. 10 is a sectional view showing a part of an integrated unit according to a fourth embodiment of the invention.
Figure 11A:
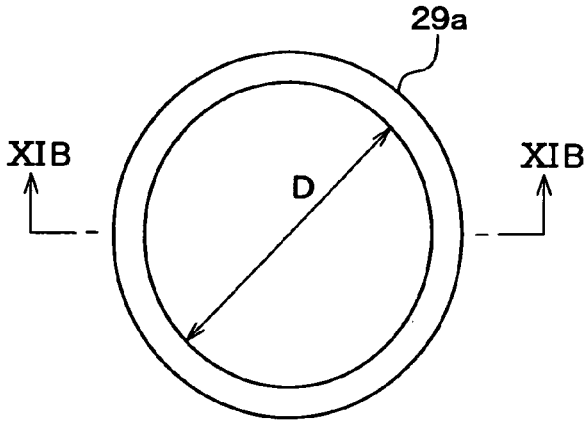
FIG. 11A is a front view of a first O-ring of the fourth embodiment.
Figure 11B:
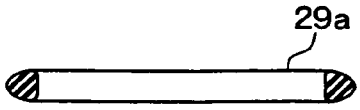
FIG. 11B is a sectional view taken along the line XIB-XIB in FIG. 11A.
Figure 12:
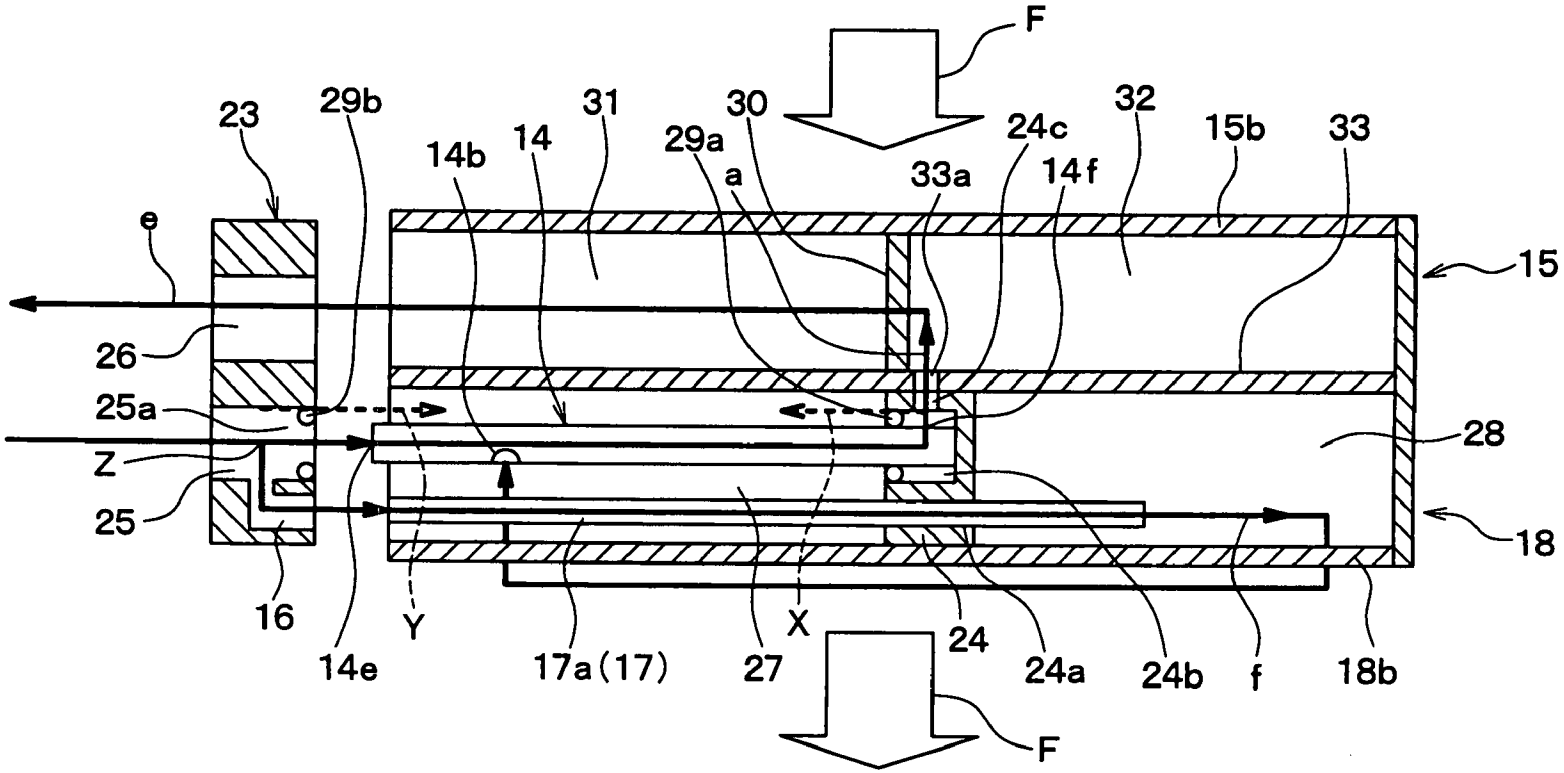
FIG. 12 RELATED ART
FIG. 12 is a sectional view showing a part of an integrated unit in the related art.

In the first embodiment, the sectional shapes of the first and second O-rings 29*a* and 29*b* are set circular, and the hardnesses of the first and second O-rings 29*a* and 29*b* are set different from each other. However, as shown in FIGS. 10, 11A, and 11B, in a fourth embodiment, the sectional shape of the first O-ring 29*a* is a substantially triangle, and the hardnesses of the first and second O-rings 29*a* and 29*b* are set to the same value.

This embodiment is the same as the first embodiment, except for the sectional shape and hardness of the first O-ring 29*a*. Thus, the second O-ring 29*b* has the same circular sectional shape as that of the first embodiment.

The second O-ring 29*b* has a circular cross section, in which the length of contact between the second O-ring 29*b* and the ejector side protrusion 14*h* is substantially the same as that of contact between the second O-ring 29*b* and the tank side protrusion 34*c*.

The term "length of contact of the second O-ring 29*b*" as used herein means the length of contact in a state where the second O-ring 29*b* is assembled to between the ejector side protrusion 14*h* and the tank side protrusion 34*c*.

The first O-ring 29*a* has a substantially triangle sectional shape with a base thereof directed toward the center of the first O-ring 29*a*, and a top thereof opposed to the base directed radially outwardly with respect to the first O-ring 29*a*. Thus, the base of the substantially triangle shape is in contact with the bottom of the groove 14*g* of the ejector 14, and the top opposed to the base is in contact with the inner peripheral surface of the circular recess 24*b* of the second connection block 24.

Thus, in the cross section, the length of contact with the inner peripheral surface of the circular recess 24*b* of the second connection block 24 (hereinafter referred to as a "tank side contact length") is shorter than the length of contact with the bottom of the groove 14*g* of the ejector 14 (hereinafter referred to as an "ejector side contact length").

The term "length of contact of the first O-ring 29*a*" as used herein means the length of contact in a state where the first O-ring 29*a* is assembled to between the ejector 14 and the second connection block 24.

In this embodiment, the hardness of each of the first and second O-rings 29*a* and 29*b* is set to 70. The hardness of the first O-ring 29*a* is large as compared to the first embodiment, and the tank side contact length is shorter than the ejector side contact length, which obtains the same seal capability and vibration isolation capability as those of the first O-ring 29*a* in the first embodiment.

That is, the shorter the tank side contact length, the smaller the tank side contact area and the lower the seal capability. Thus, the improvement of the seal capability due to the increase in hardness is compensated, whereby the same level of the seal capability as that of the first O-ring 29*a* in the first embodiment is obtained.

On the other hand, as to the vibration isolation capability, since the ejector side contact length is long in the base of the first O-ring 29*a*, the contact area of the base of the first O-ring 29*a* with the ejector 14 becomes large, so that a stress applied from the ejector 14 to the first O-ring 29*a* is distributed. In contrast, since the tank side contact length is short in the top of the second O-ring 29*a*, the contact area of the top of the first O-ring 29*a* with the upper tank 18*b* becomes small, so that a stress is collectively applied to the top, leading to an increase in amount of deformation of the top.

This results in a large effect of suppressing the transmission of vibration to the upper tank 18*b*, whereby the decrease in vibration isolation capability due to the increase in hardness is compensated, whereby the same level of the vibration isolation capability as that of the first O-ring 29*a* in the first embodiment is obtained.

As the contact area with the ejector 14 becomes larger, an elastic repulsive force applied by the first O-ring 29*a* to the ejector 14 becomes large, which simultaneously obtains an effect of preventing the first O-ring 29*a* from falling from the ejector 14.

In this embodiment, the sectional shape of the first O-ring 29*a* is substantially triangle, but may be any other shape (for example, a substantially trapezoidal shape or the like) in which the tank side contact length is smaller than the ejector side contact length.

In this embodiment, the second O-ring 29*b* has a circular cross section, and the contact length with the ejector side protrusion 14*h* is substantially the same as the contact length with the tank side protrusion 34*c* in the cross section. However, the sectional shape of the second O-ring 29*b* is not limited to a circle, and may be any shape in which a difference between the contact length with the ejector side protrusion 14*h* and the contact length with the tank side protrusion 34*c* is small as compared to a difference between the tank side contact length and the ejector side contact length in the first O-ring 29*a* so as to obtain the same effect.

(Other Embodiments)

The invention is not limited to the disclosed embodiments, and various modifications can be made to the embodiments as follows.

(1) Although in each of the above-mentioned embodiments, the integrated unit for a refrigeration cycle device according to the invention is applied to the refrigeration cycle device shown in FIG. 1, the integrated unit of the invention can be applied to various refrigeration cycle devices.

(2) Although in each of the above-mentioned embodiments, the invention is applied to an example of an arrangement structure including the upper tank 18*b* of the ejector 14, the invention is not limited thereto. The invention can be applied to various arrangement structures of the ejector 14, for example, an arrangement structure of the ejector 14 as disclosed in US 2007/0169511A1 which is incorporated herein by reference.

(3) In each of the above-mentioned embodiments, in integrally assembling respective components of the integrated unit 20, other members except for the ejector 14, that is, the first evaporator 15, the second evaporator 18, the first and second connection blocks 23 and 24, and the capillary tube 17*a* are integrally brazed to one another. However, these members can be integrally assembled by various fixing means, including screws, caulking, welding, adhesion, and the like, in addition to brazing.

(4) In each of the above-mentioned embodiments, the ejector 14 is held only by elastic contact via the first and second O-rings 29*a* and 29*b* without being in metallic contact with the upper tank 18*b*. However, a part of the ejector 14 may be brought into metallic contact with the upper tank 18*b*.

(5) Although in each of the above-mentioned embodiments, the fixing of the ejector 14 in the certain position in the longitudinal direction is performed by the engagement structure, the ejector 14 may be fixed using fixing means other than the engagement structure, for example, screws, caulking, or adhesion.

In this case, the second O-ring 29*b* cannot be sandwiched and held in the engagement structure. For this reason, the second O-ring 29*b* may be held in the groove of the ejector 14, like the first O-ring 29*a*.

(6) In the first embodiment, the engagement structure for fixing the ejector 14 in the certain position in the longitudinal direction is provided on the left end of the ejector, but may be provided at the tip of the ejector. In this case, the first O-ring 29*a*, instead of the second O-ring 29*b*, can be sandwiched and held in the engagement structure.

In the fourth embodiment, the engagement structure may be provided at the tip of the ejector. In this case, the first O-ring 29*a* has a substantially triangle sectional shape with the base thereof directed toward one side in the axial direction of the first O-ring 29*a* (toward the left end of the ejector), and the top thereof opposed to the base directed toward the other side in the axial direction of the first O-ring 29*a* (toward the tip of the ejector). This can obtain the same effect as that of the fourth embodiment.

(7) In the embodiments described above, the first and second O-rings 29*a* and 29*b* are formed of thermoplastic elastomer, but are not limited thereto. Various elastic materials having the appropriate seal capability and vibration isolation capability can form the first and second O-rings 29*a* and 29*b*.

(8) In the embodiments described above, the throttle mechanism 17 is constructed of the capillary tube 17*a* or a fixed throttle, such as an orifice. However, the throttle mechanism 17 may be an electric control valve whose valve opening degree (in which an opening degree of a passage throttle) is adjustable by an electric actuator. Alternatively, the throttle mechanism 17 may be a combination of the capillary tube 17*a* or the fixed throttle, and an electromagnetic valve.

(9) In each of the above-mentioned embodiments, the ejector 14 is a fixed ejector including the nozzle portion 14*a* with a certain passage area, but may be a variable ejector including a variable nozzle portion whose passage area is adjustable.

Specifically, the variable nozzle portion may be, for example, a mechanism in which a needle is inserted into a passage of the variable nozzle portion and a passage area is adjusted by controlling the position of the needle by an electric actuator.

(10) Although in each of the above-mentioned embodiments, the ejector 14, the first and second evaporators 15 and 18, and the throttle mechanism 17 are assembled as one integrated unit 20, the first evaporator 18 and the throttle mechanism 17 may be separately provided.

(11) Although in the description about the respective embodiments, the space of interest to be cooled by the first and second evaporators 15 and 18 is a space in a passenger compartment or a space in a refrigerator-freezor of a freezing car, the invention is not limited to the refrigeration cycle device for a vehicle. The invention can be widely applied to refrigeration cycle devices for various applications, including a fixed refrigeration cycle device.

(12) In each of the above-mentioned embodiments, the thermal expansion valve 13 and the temperature sensing portion 13*a* are constructed separately from the unit for the refrigeration cycle device. However, the thermal expansion valve 13 and the temperature sensing portion 13*a* may be integrally assembled to the unit for the refrigeration cycle device. For example, a structure for accommodating the thermal expansion valve 13 and the temperature sensing portion 13*a* in the first connection block 23 of the integrated unit 20 can be adopted. In this case, the refrigerant inlet 25 is located between the liquid receiver 12*a* and the thermal expansion valve 13, and the refrigerant outlet 26 is located between the compressor 11 and a passage portion with the temperature sensing portion 13*a* disposed therein.

The thermal expansion valve 13 is not always necessary, and may be abolished, whereby the liquid refrigerant from the liquid receiver 12*a* may be decompressed only by the ejector 14 and the capillary tube (throttle mechanism) 17*a*.

Such changes and modifications are to be understood as being within the scope of the present invention as defined by the appended claims.

What is claimed is:

1. An integrated unit for a refrigeration cycle device comprising:

an ejector that includes a nozzle portion, a refrigerant suction port for drawing refrigerant by a refrigerant flow injected from the nozzle portion, and a diffuser configured to mix the refrigerant injected from the nozzle portion and the refrigerant drawn from the refrigerant suction port and to discharge the mixed refrigerant therefrom, the ejector having an elongated shape elongated in a longitudinal direction;

an evaporator for evaporating the refrigerant to be drawn into at least the refrigerant suction port, the evaporator including at least a plurality of tubes for allowing the refrigerant to flow therethrough, and a tank for collecting the refrigerant flowing from the tubes, wherein the ejector is disposed inside the tank such that the refrigerant suction port is opened to an internal space of the tank; and a first vibration-isolating seal member and a second vibration-isolating seal member that are disposed in a gap between an outer surface of the ejector and an inner surface of the tank, each of the first and second vibration-isolating seal members being made of elastic material, the elastic material having a seal capability for preventing the refrigerant from leaking from the gap and a vibration isolation capability for preventing vibration of the ejector from being transmitted to the tank, wherein the ejector has a refrigerant flow inlet for allowing the refrigerant to flow into the nozzle portion, the refrigerant flow inlet being located at one end side of the ejector in the longitudinal direction, wherein the ejector has a refrigerant discharge port in the diffuser, for discharging the refrigerant from the diffuser, the refrigerant discharge port being located at the other end side of the ejector in the longitudinal direction, wherein the refrigerant suction port is located between the refrigerant flow inlet and the refrigerant discharge port in the longitudinal direction of the ejector, wherein the ejector serves as a refrigerant decompression means adapted to make a pressure of the refrigerant discharged from the refrigerant discharge port lower than that of the refrigerant flowing into the refrigerant flow inlet, wherein the first vibration-isolating seal member is disposed between the refrigerant discharge port and the refrigerant suction port in the longitudinal direction, to prevent the refrigerant discharged from the refrigerant discharge port from leaking to the internal space, wherein the second vibration-isolating seal member is disposed between the refrigerant flow inlet and the refrigerant suction port in the longitudinal direction, to prevent the refrigerant flowing into the refrigerant flow inlet from leaking to the internal space, wherein the first vibration-isolating seal member has the seal capability lower than the seal capability of the second vibration-isolating seal member, and the vibration isolation capability higher than the vibration isolation capability of the second vibration-isolating seal member, wherein each of the first and second vibration-isolating seal members is configured to have a ring shape that surrounds an outer peripheral surface of the ejector, wherein the first vibration-isolating seal member has a sectional shape in which a length of contact with an inner surface of the tank is shorter than a length of contact with an outer surface of the ejector in a cross section of the first vibration-isolating seal member perpendicular to a circumferential direction thereof, and wherein the second vibration-isolating seal member has a sectional shape in which a difference between a length of contact with the outer surface of the elector and a length of contact with the inner surface of the tank is small in a cross section of the second vibration-isolating seal member perpendicular to a circumferential direction thereof, as compared to that in the first vibration-isolating seal member, thereby to obtain the seal capability and the vibration isolation capability.

2. The integrated unit for the refrigeration cycle device according to claim 1, wherein a hardness of the first vibration-isolating seal member is set lower than a hardness of the second vibration-isolating seal member to obtain the seal capability and the vibration isolation capability.

3. The integrated unit for the refrigeration cycle device according to claim 2, wherein the hardness of the first vibration-isolating seal member is set in a range of 60 to 80% of the hardness of the second vibration-isolating seal member.

4. The integrated unit for the refrigeration cycle device according to claim 1, wherein the second vibration-isolating seal member is constructed of a plurality of elastic members, and wherein the first vibration-isolating seal member is constructed of at least one elastic member, the number of which is smaller than that of the elastic members of the second vibration-isolating seal member thereby to obtain the seal capability and the vibration isolation capability.

5. The integrated unit for the refrigeration cycle device according to claim 1, wherein the first vibration-isolating seal member has a substantially triangle sectional shape with a base thereof being in contact with the outer surface of the ejector and a top thereof opposed to the base being in contact with the inner surface of the tank, and wherein the second vibration-isolating seal member has a substantially circular sectional shape.

6. The integrated unit for the refrigeration cycle device according to claim 1, wherein the tank has a tank side protrusion provided at the inner surface thereof and protruding toward the outer surface of the ejector, wherein the ejector has an ejector side protrusion provided at the outer surface thereof and protruding toward the inner surface of the tank, the ejector side protrusion being engaged with the tank side protrusion, and wherein the ejector side protrusion is engaged with the tank side protrusion in the longitudinal direction toward the refrigerant discharge port from the refrigerant flow inlet.

7. The integrated unit for the refrigeration cycle device according to claim 6, wherein the ejector side protrusion is engaged with the tank side protrusion via any one of the first vibration-isolating seal member and the second vibration-isolating seal member.

8. An integrated unit for a refrigeration cycle device comprising:

an ejector that includes a nozzle portion, a refrigerant suction port for drawing refrigerant by a refrigerant flow injected from the nozzle portion, and a diffuser configured to mix the refrigerant injected from the nozzle portion and the refrigerant drawn from the refrigerant suction port and to discharge the mixed refrigerant therefrom, the ejector having an elongated shape elongated in a longitudinal direction;

an evaporator for evaporating the refrigerant to be drawn into at least the refrigerant suction port, the evaporator including at least a plurality of tubes for allowing the refrigerant to flow therethrough, and a tank for collecting the refrigerant flowing from the tubes, wherein the ejector is disposed inside the tank such that the refrigerant suction port is opened to an internal space of the tank; and a first vibration-isolating seal means and a second vibration-isolating seal means that are provided between an outer surface of the ejector and an inner surface of the tank, each of the first and second vibration-isolating seal means having a seal capability for preventing the refrigerant from leaking and a vibration isolation capability for preventing vibration of the ejector from being transmitted to the tank, wherein the nozzle portion has a refrigerant flow inlet located at one end side of the ejector in the longitudinal direction, and the diffuser has a refrigerant discharge port located at the other end side of the ejector in the longitudinal direction, wherein the refrigerant suction port is located between the refrigerant flow inlet and the refrigerant discharge port in the longitudinal direction of the ejector, wherein the first vibration-isolating seal means is provided between the refrigerant discharge port and the refrigerant suction port in the longitudinal direction, to prevent the refrigerant discharged from the refrigerant discharge port from leaking to the internal space, wherein the second vibration-isolating seal means is provided between the refrigerant flow inlet and the refrigerant suction port in the longitudinal direction, to prevent the refrigerant flowing into the refrigerant flow inlet from leaking to the internal space, wherein the first vibration-isolating seal means has the seal capability lower than the seal capability of the second vibration-isolating seal means, and the vibration isolation capability higher than the vibration isolation capability of the second vibration-isolating seal means, wherein each of the first and second vibration-isolating seal members is configured to have a ring shape that surrounds an outer peripheral surface of the ejector, wherein the first vibration-isolating seal member has a sectional shape in which a length of contact with an inner surface of the tank is shorter than a length of contact with an outer surface of the ejector in a cross section of the first vibration-isolating seal member perpendicular to a circumferential direction thereof, and wherein the second vibration-isolating seal member has a sectional shape in which a difference between a length of contact with the outer surface of the ejector and a length of contact with the inner surface of the tank is small in a cross section of the second vibration-isolating seal member perpendicular to a circumferential direction thereof, as compared to that in the first vibration-isolating seal member, thereby to obtain the seal capability and the vibration isolation capability.

* * * * *